US008607897B2

(12) United States Patent
Kollé et al.

(10) Patent No.: US 8,607,897 B2
(45) Date of Patent: Dec. 17, 2013

(54) CENTER DISCHARGE GAS TURBODRILL

(75) Inventors: Jack J. Kollé, Seattle, WA (US); Kenneth Theimer, Auburn, WA (US)

(73) Assignee: Trican Well Service, Ltd., Calgary (CA)

( * ) Notice: Subject to any disclaimer, the term of this patent is extended or adjusted under 35 U.S.C. 154(b) by 415 days.

(21) Appl. No.: 12/916,024

(22) Filed: Oct. 29, 2010

(65) Prior Publication Data

US 2011/0100715 A1 May 5, 2011

Related U.S. Application Data

(60) Provisional application No. 61/256,211, filed on Oct. 29, 2009.

(51) Int. Cl.
*E21B 4/02* (2006.01)

(52) U.S. Cl.
USPC ..... 175/107; 175/71

(58) Field of Classification Search
USPC ..... 175/71, 107; 475/71, 59; 415/1
See application file for complete search history.

(56) References Cited

U.S. PATENT DOCUMENTS

| | | | | | |
|---|---|---|---|---|---|
| 2,990,895 | A * | 7/1961 | Works et al. | ..... | 175/107 |
| 3,232,362 | A * | 2/1966 | Cullen et al. | ..... | 175/104 |
| 3,365,170 | A * | 1/1968 | Whittle | ..... | 415/69 |
| 3,465,837 | A * | 9/1969 | Ryder et al. | ..... | 175/26 |
| 3,669,199 | A * | 6/1972 | Cullen et al. | ..... | 175/106 |
| 3,754,835 | A * | 8/1973 | Ivanov et al. | ..... | 415/122.1 |
| 4,170,441 | A * | 10/1979 | Trzeciak | ..... | 418/48 |
| 4,222,445 | A * | 9/1980 | Vadetsky et al. | ..... | 175/106 |
| 6,892,829 | B2 | 5/2005 | Livingstone | ..... | 175/57 |
| 7,600,586 | B2 * | 10/2009 | Hall et al. | ..... | 175/61 |
| 7,802,638 | B2 * | 9/2010 | Downie et al. | ..... | 175/107 |
| 8,365,843 | B2 * | 2/2013 | Hall et al. | ..... | 175/273 |
| 8,371,400 | B2 * | 2/2013 | Hall et al. | ..... | 175/273 |
| 2007/0119630 | A1 * | 5/2007 | Hall et al. | ..... | 175/73 |
| 2008/0142264 | A1 * | 6/2008 | Hall et al. | ..... | 175/45 |
| 2008/0264693 | A1 * | 10/2008 | Downie et al. | ..... | 175/106 |
| 2009/0057016 | A1 * | 3/2009 | Hall et al. | ..... | 175/57 |
| 2010/0187009 | A1 * | 7/2010 | Siher et al. | ..... | 175/57 |
| 2010/0212965 | A1 * | 8/2010 | Hall et al. | ..... | 175/101 |
| 2010/0212966 | A1 * | 8/2010 | Hall et al. | ..... | 175/106 |
| 2011/0100715 | A1 * | 5/2011 | Koll et al. | ..... | 175/71 |
| 2013/0076527 | A1 * | 3/2013 | Sitka et al. | ..... | 340/854.4 |

OTHER PUBLICATIONS

Lyons, et al., "Downhole Pneumatic Turbine Motor: Testing and Simulation Results," SPE Drilling Engineering, Sep. 1990, pp. 239-246.

* cited by examiner

*Primary Examiner* — Daniel P Stephenson
(74) *Attorney, Agent, or Firm* — Lee & Hayes, PLLC

(57) ABSTRACT

A compact gas turbine motor and a speed reduction transmission capable of providing the speed and torque required for drilling with center discharge bits. The transmission includes two sun gears of different pitch diameters, keyed to the turbine shaft. Upper planet gears, whose carrier is fixed in place, drive an outer ring gear, which engages lower planet gears having a different pitch diameter. The lower planet gears engage the lower sun gear. Due to the different pitch diameters of the sun gears and planet gears, the gear carrier for the lower planet gears rotates in the same direction as the turbine shaft, but at a much slower rate. Exhaust gas from the turbine can be directed through one or more flow restriction elements to increase gas density in the turbine, further reducing turbine speed. The flow restriction element can comprise a venturi, to provide a vacuum assist to remove cuttings.

29 Claims, 6 Drawing Sheets

CENTER DISCHARGE GAS TURBODRILL

RELATED APPLICATIONS

Figure 1:
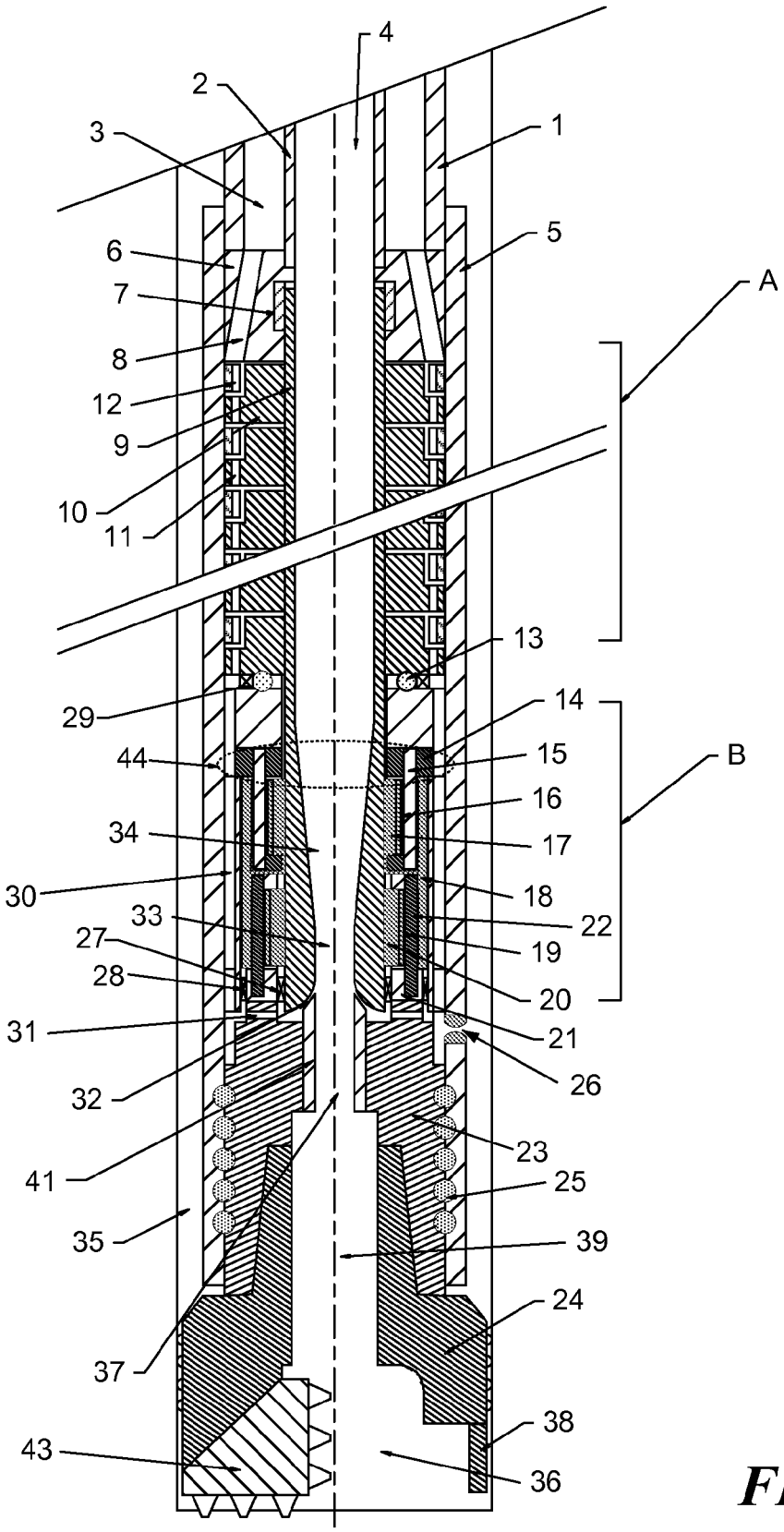

This application is based on a prior copending provisional application Ser. No. 61/256,211, filed on Oct. 29, 2009, the benefit of the filing date of which is hereby claimed under 35 U.S.C. §119(e).

BACKGROUND

Reverse-circulation, center-discharge drilling (RCCD) through concentric tubing is a proven method for minimizing formation damage while drilling producing formations, such as tight gas sand and coal bed methane. Because RCCD drilling returns cuttings through the inner diameter of a double-wall drill pipe, it does not expose the formation to possible damage from drilling fluid and cuttings.

This technique is accomplished with a concentric rotary drill string and a center discharge drill bit. A vacuum may be applied at the surface to reduce the bit face pressure to a level below the formation pore pressure, to further reduce the potential for formation damage; however, the vacuum assist from this approach is limited.

The deployment of concentric jointed tubing represents significant additional time and cost for drilling the well to completion. Concentric coiled tubing (CCT) can speed the deployment time, and allows continuous drilling operations in the producing formation. Drilling operations using coiled tubing requires a motor to turn the drill bit. Rotary drilling motors capable of operating on dry gas with a center discharge are not available.

It is generally desirable to operate a drill motor on dry gas for completion drilling of water sensitive formations. Progressive cavity motors incorporate elastomeric stators that degrade rapidly when operated on dry gas. Turbodrills are capable of operation on gas, but these tools stall easily when operated on gas, and the motor speed is generally much too high for effective drilling. These motors also tend to be very long, which limits steerability. A previous attempt to develop a gas turbine motor for drilling application involved the use of a multi-stage planetary gear, to increase torque and reduce the speed, to drive a conventional roller cone drill bit. The relatively high cost and complexity of the multistage planetary gearbox prevented commercial acceptance of that design. Further, the transmission employed in that design was not suited for a center discharge passage.

It would be desirable to provide a compact, steerable gas turbine motor and a speed reduction transmission suitable for RCCD drilling, capable of providing the speed and torque required for drilling with conventional roller cone or polycrystalline diamond compact (PDC) bits.

SUMMARY

This application specifically incorporates by reference the disclosures and drawings of each patent application and issued patent identified above as a related application.

A first aspect of the concepts disclosed herein is a drill tool including a compact, steerable gas turbine motor and a speed reduction transmission capable of providing the speed and torque required for drilling with conventional roller cone or polycrystalline diamond compact (PDC) bits. Significantly, the concepts disclosed herein combine a relatively high speed turbine with a relatively compact differential planetary gear transmission capable of providing a significant speed reduction ratio. High speed operation of the turbine section allows efficient mechanical power generation in a relatively short turbine. The differential planetary gear transmission offers high speed reduction ratio in a short package relative to multistage planetary gears. Thus, the concepts disclosed herein enable a compact drill tool to be provided. Compactness is important if one desires to steer the tool, as the turning radius increases as the tool lengthens. In an exemplary, but not limiting embodiment, a drill tool combining a gas turbine and compact differential planetary gear transmission will have a diameter of about 3.75" and a length of about 48", which allows the tool to be mounted on a bent housing for steering applications.

The transmission employs multistage differential planetary gears, configured to accommodate a center discharge passage along a central axis of the transmission, which is in fluid communication with a similar center discharge passage in the turbine, which couples in fluid communication with an inner tube in a concentric tubing drill string or coiled tube drill string. The transmission includes an upper sun gear coupled to an output shaft of the gas turbine motor, a lower sun gear coupled to the output shaft of the gas turbine motor, an upper spider assembly rotatably supporting a plurality of upper planet gears, a lower spider assembly rotatably supporting a plurality of lower planet gears, and a ring gear circumferentially engaging the planetary gears. The upper spider assembly is fixed in position (i.e., is fixedly attached to a housing of the tool), such that rotation of the upper sun gear results in the rotation of the ring gear at a reduced speed. A diameter of the lower sun gear is different than a diameter of the upper sun gear, and the diameters of the lower planetary gears are also different than the diameters of the upper planetary gears, such that the lower spider assembly rotates at a further reduced speed. In at least one embodiment, the transmission enables a speed reduction ratio and torque ratio of about 32:1 to be achieved.

A second aspect of the concepts disclosed herein is the incorporation of a flow restriction element in the drill tool defined above, the flow restriction element providing a mechanism to increase a density of the gas in the turbine section, which results in reducing a rotational speed of the turbine output shaft, providing an additional speed reduction capability. In an exemplary but not limiting embodiment, the flow restriction element is a port in an outer housing of the tool disposed below the turbine section, the port being coupled in fluid communication with the wellbore. In most cases of reverse circulation drilling the wellbore is sealed, so that the only flow path for the gas discharged from the flow restriction port is though the central passage in the bit, and upward through the central passage in the transmission and turbine. The flow restriction element can be sized to control the motor speed. If desired, the flow restriction may be ported to the bottom of the assembly to provide better bit cleaning. If the borehole is not sealed, the flow restriction port can be sealed. In an exemplary embodiment, the flow restriction port is reconfigurable, such that the tool (i.e., the tool comprising the turbine, the differential planetary transmission, and the flow restriction port) can be removed from the wellbore to modify the flow restriction port, enabling the drill speed achieved by the tool to be modified to suit a particular wellbore application.

A third aspect of the concepts disclosed herein is the incorporation of a venturi into the center discharge volume, to provide vacuum assist to reduce bottom hole pressure. Reducing bottom hole pressure below formation pressure, and vacuuming cuttings though the center of the bit, prevents fine cuttings from contacting the formation and prevents damage to wellbore permeability. In an exemplary, but not limiting embodiment, a center discharge drill bit coupled to the center discharge tool (i.e., the tool comprising the turbine, the differential planetary transmission and the venturi) is equipped with a skirt to direct flow entrained by the venturi around the cutters of the bit. In an exemplary, but not limiting embodiment, the venturi is implemented using a removable tubular venturi element fitted to the center discharge volume, such that the venturi can be reconfigured (or eliminated) by replacing or removing the tubular venturi element. Gas discharged from the turbine and routed around the differential planetary transmission is used to generate a Coanda-effect venturi capable of generating the desired pressure differential between the bit face and inlet to the inner return line of the concentric tubing (i.e., the center discharge volume). The venturi, in addition to generating the vacuum assist, also functions as a flow restriction element, increasing a gas density in the turbine and reducing turbine speed.

In a related embodiment, the central discharge volume in the tool is plugged, and turbine and differential planetary gear transmission discussed above are used to energize a non-center discharge drill bits, and cuttings are retrieved at the surface using the annulus between the tool and the borehole.

This Summary has been provided to introduce a few concepts in a simplified form that are further described in detail below in the Description. However, this Summary is not intended to identify key or essential features of the claimed subject matter, nor is it intended to be used as an aid in determining the scope of the claimed subject matter.

DRAWINGS

Figure 2:
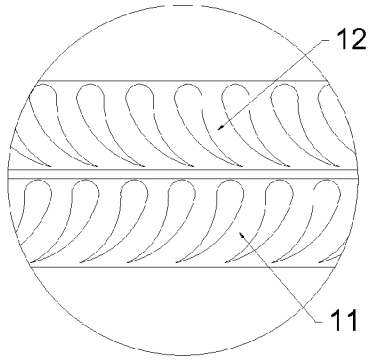
Figure 3:
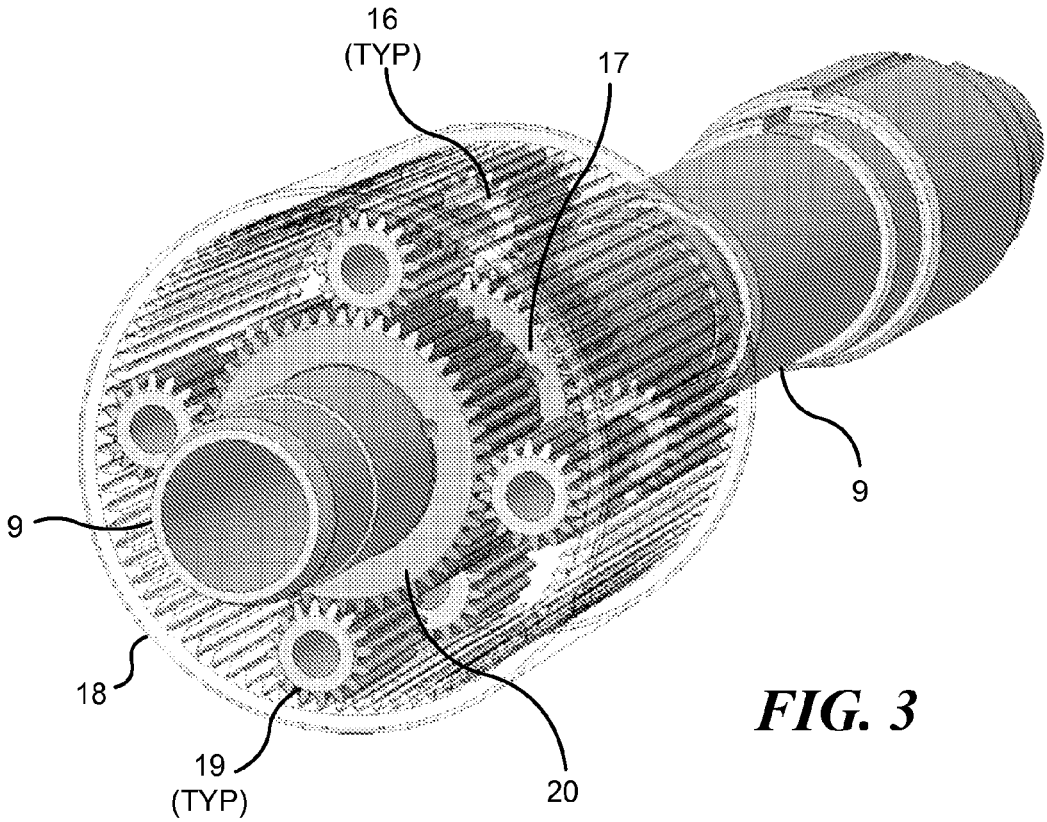
Figure 4:
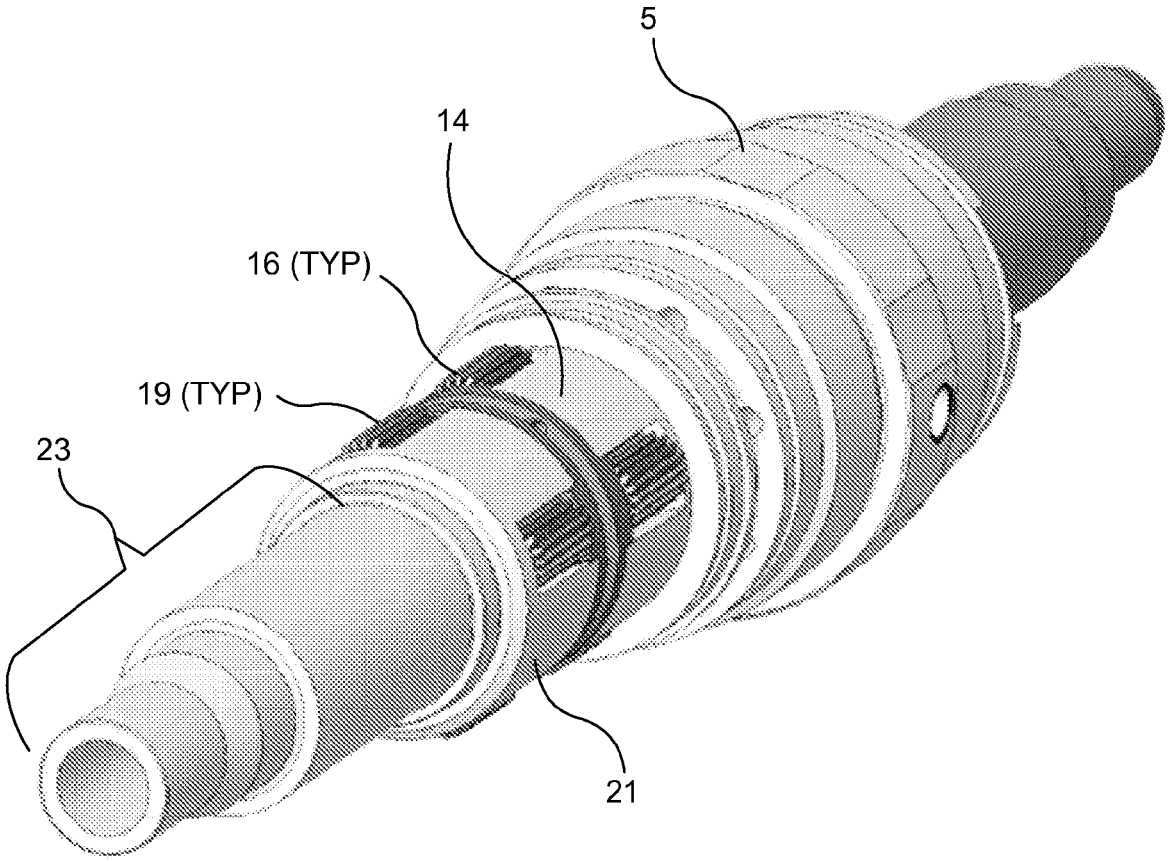
Figure 5:
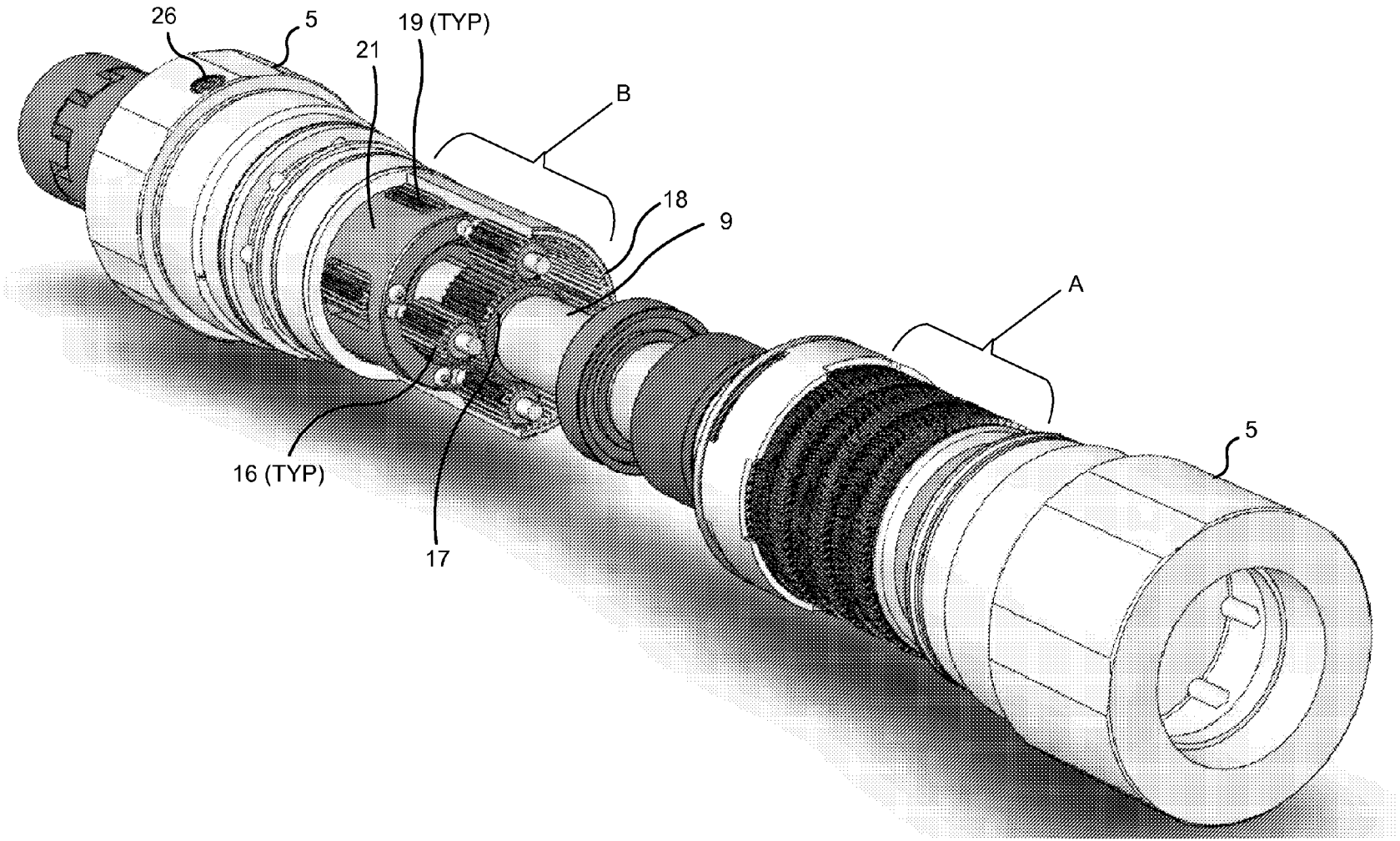
Figure 6:
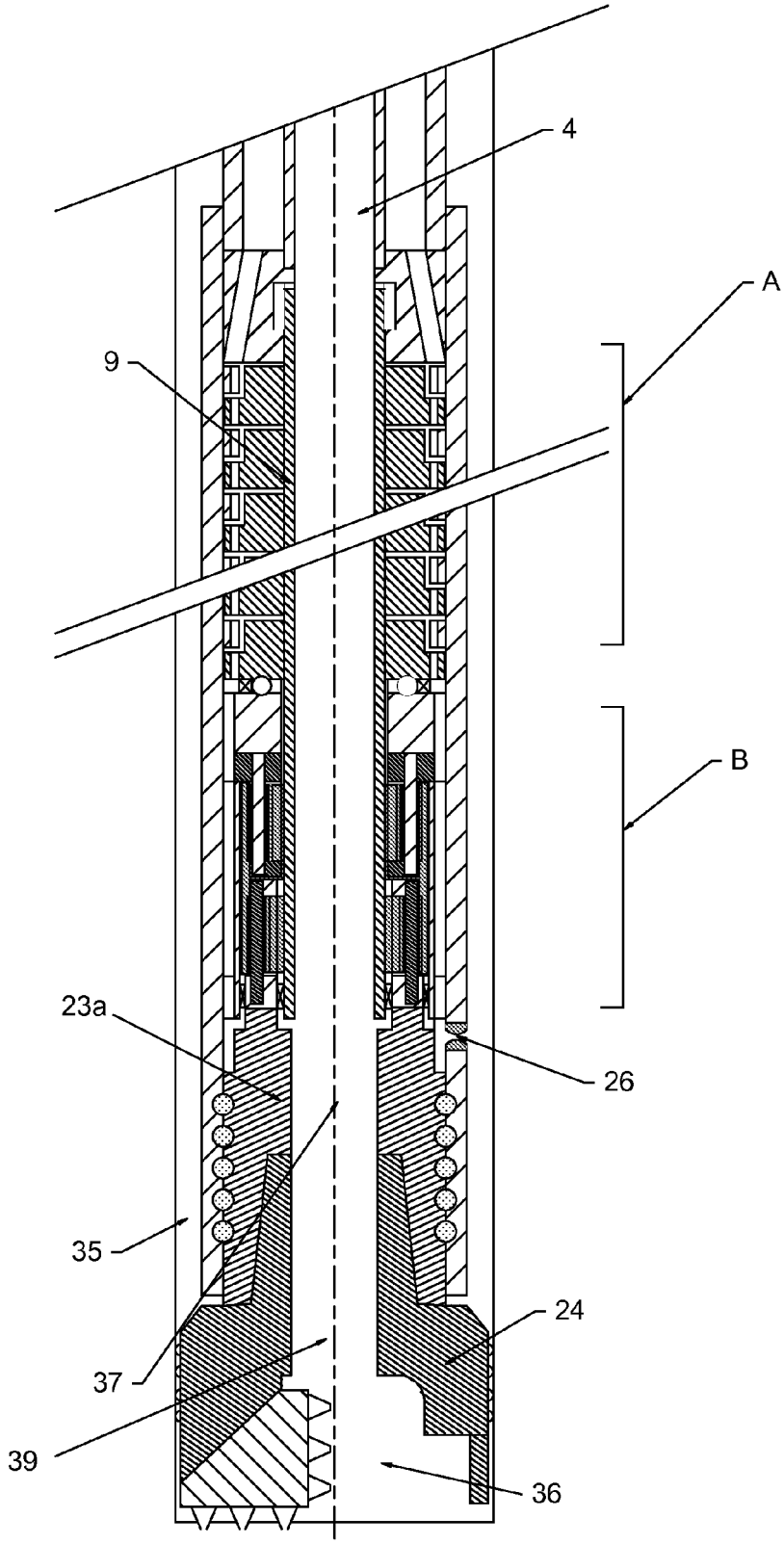
Figure 7:
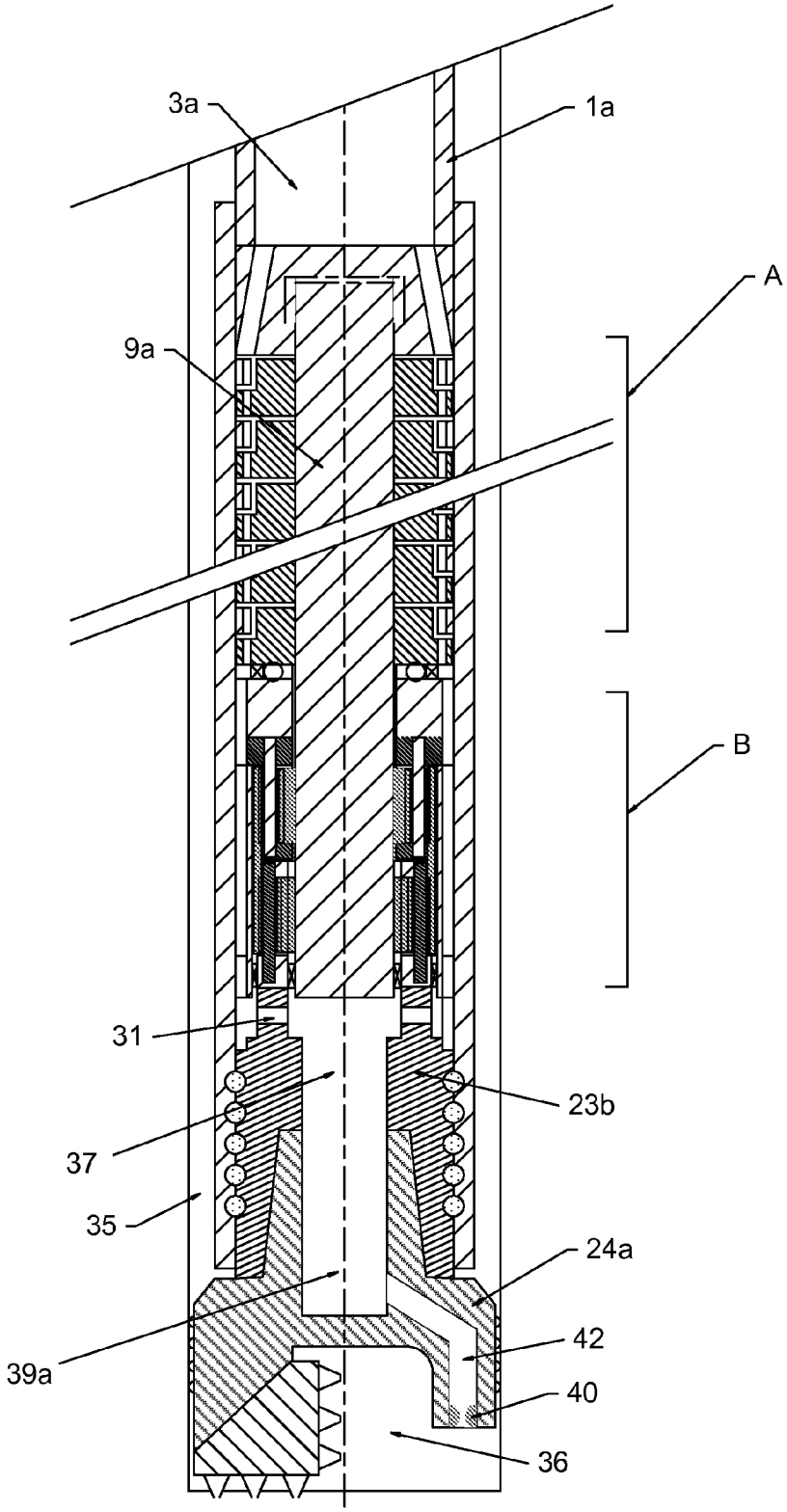

Various aspects and attendant advantages of one or more exemplary embodiments and modifications thereto will become more readily appreciated as the same becomes better understood by reference to the following detailed description, when taken in conjunction with the accompanying drawings, wherein:

FIG. 1 is a cross-sectional side view of a first exemplary embodiment of a center discharge gas turbine motor with speed reduction and an integral venturi for providing a vacuum assist to reduce bottom hole pressure to facilitate removal of cuttings and/or debris via the center discharge volume;

FIG. 2 schematically illustrates an exemplary rotor and stator configuration for the center discharge gas turbine motor of FIG. 1;

FIG. 3 schematically illustrates an exemplary differential planetary gear transmission employed for speed reduction in the center discharge gas turbine motor of FIG. 1, with spider assemblies for the planetary gears omitted for illustrative purposes;

FIG. 4 schematically illustrates the exemplary differential planetary gear transmission of FIG. 3, with an outer ring gear omitted for illustrative purposes;

FIG. 5 schematically illustrates the tool of FIG. 1, with selected portions of the tool being cut away for illustrative purposes;

FIG. 6 is a cross-sectional side view of a second exemplary embodiment of a center discharge gas turbine motor with speed reduction, but without the integral venturi implemented in the embodiment of FIG. 1; and FIG. 7 is a cross-sectional side view of a third exemplary embodiment of a center discharge gas turbine motor with speed reduction, but without the integral venturi implemented in the embodiment of FIG. 1, and modified to direct debris to the surface via an annulus between the tool and the borehole, rather than through a center discharge passage in the tool.

DESCRIPTION

Figures and Disclosed Embodiments are not Limiting

Exemplary embodiments are illustrated in referenced Figures of the drawings. It is intended that the embodiments and Figures disclosed herein are to be considered illustrative rather than restrictive. No limitation on the scope of the technology and of the claims that follow is to be imputed to the examples shown in the drawings and discussed herein. Further, it should be understood that any feature of one embodiment disclosed herein can be combined with one or more features of any other embodiment that is disclosed, unless otherwise indicated.

FIG. 1 is a cross-sectional side view of a first exemplary embodiment of a center discharge gas turbine motor with speed reduction and an integral venturi for providing a vacuum assist to reduce bottom hole pressure to facilitate removal of cuttings and/or debris via the center discharge volume. The center discharge gas turbine motor of FIG. 1 can be used with a concentric tubing supply including an outer tube 1 and an inner tube 2, which define an annular passage 3, through which a supply of compressed gas is provided to a gas turbine A. The concentric tubing is coupled to a turbine housing 5 and an inlet manifold 6. The gas supplied by the concentric tubing flows though inlet passages 8 to a stator passage 12, which swirls the gas flow. The swirling flow is directed though rotor passages 11 in rotor 10 generating torque. The rotor and stator flow passages are shown schematically in FIG. 2. Multiple pairs of stators and rotors combine to result in a multistage turbine. The rotors are fixed to a turbine shaft 9, which is supported by an upper journal bearing 7 and an axial radial bearing 13. Turbine shaft 9 is free to rotate, and the gas flow through the stator and rotor pair causes the turbine shaft to rotate.

The center discharge gas turbine tool of FIG. 1 includes a central discharge volume that is coupled in fluid communication with a return line 4 of the concentric tubing. Significantly, turbine shaft 9 is hollow about its central axis, and the hollow turbine shaft defines a portion of the central discharge volume. An annular gap between upper journal bearing 7 and turbine shaft 9 is a clearance fit that also acts as a pressure seal between the turbine inlet (annular passage 3 and inlet passages 8) and the center discharge volume. Axial radial bearing 13 is supported by the housing.

The rotation of the turbine shaft is transmitted through differential planetary gear transmission B, which increases torque and slows the rotation rate to a level that is useful for drilling with a roller cone bit 24. Other bit types may also be used with the concepts disclosed herein. A distal portion of turbine shaft 9 extends into differential planetary gear transmission. An upper sun gear 17 and a lower sun gear 20 rotatingly engage the turbine shaft. Note that the hollow center of the turbine shaft (which forms part of the central discharge volume) enables gas diverted distal of the differential planetary gear transmission to flow from a distal portion of the housing to a proximal portion of the housing through the central discharge volume. Upper sun gear 17 engages upper planet gears 16 (which are rotatably supported by upper shafts 15 in upper spider 14; noting that upper spider 14 is a planet gear carrier, and in an exemplary embodiment, each upper planet gear is the same size), which in turn engage an outer ring gear 18. Upper sun gear 17 thus functions as an input (being drivingly rotated by the turbine shaft). Upper spider 14 is fixed to housing 5, so outer ring gear 18 rotates with a lower speed and greater torque relative to the input provided by the turbine shaft.

A further speed reduction and torque increase is provided by the lower portion of the differential planetary gear transmission. The lower portion of the differential planetary gear transmission includes a lower spider 21, which rotatingly supports lower planet gears 19 (via lower shafts 22; noting that lower spider 21 is a planet gear carrier, and in an exemplary embodiment, each lower planet gear is the same size), and lower sun gear 20 (which is drivingly rotated by the turbine shaft). Lower planet gears 19 engage both outer ring gear 18 and lower sun gear 20. Significantly, upper sun gear 17 and lower sun gear 20 have different diameters, as do upper planet gears 16 and lower planet gears 19. The differential sizes of the sun gears and the planet gears, and the motion of the lower planet gears due to the rotation of the turbine shaft and the outer ring gear, results in the rotation of lower spider 21 at a lower speed and greater torque relative to outer ring gear 18 (and to an even greater extent, the turbine shaft), providing the further speed reduction and torque increase. Those skilled in the art will recognize that the size and number of teeth on the gears may be selected so that the lower spider rotates at much lower speed and is driven at much higher torque than the turbine shaft. In an exemplary but not limiting embodiment, the differential planetary gear transmission provides a speed reduction ratio and torque ratio of about 32:1. Exemplary, but not limiting gear dimensions are provided in Table 1.

TABLE 1

Exemplary Gear Dimensions

| | Number of Teeth | Pitch Diameter, inch |
|---|---|---|
| Upper Sun Gear 17 | 36 | 1.125 |
| Lower Sun Gear 20 | 40 | 1.250 |
| Upper Planetary Gears 16 | 24 | 0.750 |
| Lower Planetary Gears 19 | 22 | 0.688 |
| Ring Gear 18 | 84 | 2.625 |

Further details of the differential planetary gear transmission B are shown in FIGS. 3, 4, and 5. The gears are identified in FIG. 3, which has the spiders rendered invisible. In an exemplary embodiment, there are four upper planetary gears 16 and four lower planetary gears 19. Sun gears 17 and 20 can be seen in FIG. 3, along with outer ring gear 18 and hollow turbine shaft 9.

Upper spider 14 and lower spider 21 are shown in FIG. 4, which has the ring gear removed for clarity. Upper planetary gears 16 and lower planetary gears 19 can also be seen in FIG. 4, along with a portion of housing 5. As shown in FIG. 4, coupling unit 23 can be formed out of a plurality of subcomponents, as opposed to being formed as an integral unit, as schematically indicated in FIG. 1. It should be recognized that components that are schematically indicated as being formed as a single integral component in any of the drawings provided herein can be implemented by using a plurality of subcomponents coupled together to achieve the required structure.

FIG. 5 is a cut away schematic view of the tool of FIG. 1, enabling portions of differential planetary gear transmission B to be visualized, with portions of the tool housing, the outer ring gear and the fixed spider (i.e., upper spider 14) omitted for illustrative purposes. Referring to FIG. 5, the upper end of the tool (i.e., the proximal end of the tool to be coupled to concentric tubing or some other gas supply) is disposed in the lower right corner of the Figure, while the lower end of the tool (i.e., the distal end of the tool to be coupled to a drill bit) is disposed in the upper left corner of the Figure. Stator and rotor elements of gas turbine A can be seen proximate the proximal end of the tool. Elements from differential planetary gear transmission B can be seen, including a portion of ring gear 18, upper sun gear 17, upper planetary gears 16, lower spider 21, and lower planetary gears 19. Turbine shaft 9 can be seen passing through differential planetary gear transmission B. Note that a port in the housing used to implement flow restriction 26 can be seen in the upper left of the Figure.

Referring once again to FIG. 1, in an exemplary but not limiting embodiment, the differential planetary gear transmission is partially filled with gear oil, which is sealed within the differential planetary gear transmission by rotary seals 27, 28 and 29. In an exemplary embodiment, pressure inside the transmission is ported to a turbine exhaust pressure passage 30, to eliminate all differential pressure across the transmission rotary seals 27, 28 and 29. While not specifically shown in FIG. 1, in an exemplary embodiment, the transmission is pressure balanced using two small vent ports in the upper end of the transmission, generally as indicated by an area 44. Those vents ports are coupled in fluid communication with turbine exhaust pressure passage 30 (hence area 44 encompasses both the upper end of the transmission and passages 30, the perspective of FIG. 1 preventing the actual vent passages from being displayed). When the transmission is partially filled with oil, the vent ports will be positioned above the oil level, so that oil does not drain through the vent ports when the tool is positioned normally. In operation, a small amount of oil spray could be discharged through the vent ports, however, a small amount of oil loss will not be detrimental.

Lower spider 21 (which provides the output of the differential planetary gear transmission) is fixed to a coupling 23, which is supported by radial bearings 25, so that coupling 23 is free to rotate relative to turbine housing 5. Roller cone drill bit 24 is attached to coupling 23, enabling the output of the differential planetary gear transmission to be used to drive the bit. Although a roller cone bit is shown in the Figures, those skilled in the art will recognize that other open-flow center-discharge bit types may be used. Note that coupling 23 also includes an axial volume 37 that is coupled in fluid communication with the hollow axial portion of the turbine shaft, extending the central discharge volume to the bit, which itself includes an axial volume 39, which in turn extends the central discharge volume to a bit face 36, enabling cuttings and debris from the bit face to be placed in fluid communication with return line 4 of the concentric tubing. Thus, it should be understood that the center discharge volume coupling bit face 36 to return line 4 of the concentric tubing includes the hollow turbine shaft, axial volume 37 in coupling 23, and axial volume 39 in bit 24.

Gas exhausted from turbine section A passes around the differential planetary gear transmission through turbine exhaust pressure passages 30. A portion of the exhaust gas may be exhausted into an annulus 35 between the housing and the borehole in which the tool is disposed through a flow restriction 26. The remaining exhaust gas flow is ported through passages 31 to an annular gap 32, between a bottom of turbine shaft 9 and coupling 23. Note that annular gap 32 also forms a flow restriction. The combined area of annular gap 32 and flow restriction 26 can be sized to increase the discharge pressure of the turbine, which increases the discharge gas density, and provides additional speed control over the turbine (i.e., speed control beyond that provided by the differential planetary gear transmission).

Significantly, annular gap 32 defines a primary jet of a Coanda-effect venturi capable of generating a pressure differential between the bit face and inner return line 4 of the concentric tubing. The annular primary gas jet entrains secondary gas and cuttings from bit face 36 though axial volume 37 in coupling 23. The primary and secondary flows are mixed in a mixing duct 33, imparting momentum to the flow. The mixed flow momentum is recovered in a diffuser section 34 to maintain pressure in return line 4 to pump gas and cuttings to surface. In an exemplary embodiment, mixing duct 33 and diffuser section 34 are formed by tubular inserts placed into a distal end of the hollow turbine shaft, although if desired they can be formed integrally into the turbine shaft. The use of inserts is somewhat preferred, as inserts can be removed and replaced to enable changes to the mixing and diffusing to be implemented. In an exemplary, but not limiting embodiment, a replaceable tube 41 is used to form the inner diameter of gap 32. Tubes of different diameters can be installed to adjust the flow area of gap 32. The gap dimension can be minimal, in which case, the venturi effect is eliminated.

The venturi feature provides a vacuum assist to reduce bottom hole pressure. By reducing bottom hole pressure below the formation pressure, and vacuuming cuttings though the center of the bit, fine cuttings are prevented from contacting the formation and possibly damaging wellbore permeability. In a preferred embodiment, center discharge roller cone drill bit 24 is equipped with a skirt 38 to direct flow entrained by the venturi around cutters 43 of the bit. In a sealed borehole, the area ratio between flow restriction 26 and annular gap 32 determines the ratio of entrained secondary gas to primary. If the borehole is not sealed, flow restriction 26 can be plugged. The venturi will entrain gas from the formation or from the wellhead to clean the cuttings from the face of the bit. To reiterate, the primary gas stream is exhaust gas from the turbine flowing in passages 30 through annular gap 32 into the center discharge volume. The secondary gas stream is from exhaust gas exiting flow restriction 26, moving around the bit, and up into the center discharge volume through the axial volumes in the bit and coupler.

In another embodiment of the concepts disclosed herein shown in FIG. 6, the venturi features (i.e., annular gap 32, mixing duct 33 and diffuser section 34) are omitted. Gas exhausted from flow restriction 26 into the well bore passes through axial volume 39 in center discharge roller cone bit 24, through axial volume 37 in a coupling 23*a*, through the hollow turbine shaft and into return line 4 of the concentric tubing. Thus, the embodiment of FIG. 6 enables speed controlled (via the flow restriction and the differential planetary gear transmission) center discharge drilling capability without a vacuum assist to reduce bottom hole pressure. The flow restriction 26 can be sized to further control the motor speed (i.e., beyond the speed reduction and torque increase provided by the differential planetary gear transmission). If desired, the location of the flow restriction may be moved to the bottom of the assembly to provide better bit cleaning. Note that the embodiment of FIG. 6 employs a slightly modified coupling 23*a*, that is used to couple the output of the differential planetary gear transmission to the drill bit. Note that coupling 23*a* does not need to include passages 31 coupling turbine exhaust passages 30 to axial volume 37, nor the step in coupling 23 proximate venturi tube 41.

In another embodiment of the concepts disclosed herein shown in FIG. 7, the center discharge features may be eliminated altogether to provide conventional drilling with cuttings return though the annulus. Gas is supplied to the turbine through a passage 3*a* in supply tube 1*a*. Exhaust from the turbine flows through passages 30 and 31 in the housing and a passage 42 in a jetted drill bit 24*a* to a flow restriction 40. Cuttings are transported up annulus 35 between the external surfaces of the tool and the borehole to the surface. Any type of jetted bit may be used with this motor. The dimensions of bit flow restriction 40 can be sized to control the motor speed. As shown in FIG. 7, a turbine shaft 9*a* has a solid core, as opposed to the hollow turbine shaft in the center discharge embodiments. It should be recognized that a hollow turbine shaft could be used in the embodiment of FIG. 7, so long as the central discharge passage is plugged. For example, one or both ends of the hollow turbine shaft of FIGS. 1 and 6 could be capped, enabling the hollow turbine shaft design to be utilized to implement the embodiment of FIG. 7 (i.e., an embodiment that transports cuttings to the surface via annulus 35, as opposed to a center discharge passage in the tool). Note also that the embodiment of FIG. 7 employs a slightly modified coupling 23*b*, that is used to couple the output of the differential planetary gear transmission to the drill bit, as compared to coupling 23 in FIG. 1. Coupling 23 in FIG. 1 includes a step that can be used to help position venturi tube 41. As the venturi is not implemented in the embodiment of FIG. 7, the step can be omitted from coupling 23*b* in FIG. 7. Additional differences between the embodiments of FIGS. 1 and 6 and the embodiment of FIG. 7 is that drill bit 24*a* includes an axial volume 39*a* that is different than axial volume 39 in center discharge drill bit 24 of FIGS. 1 and 6.

In each embodiment, the relative sizes of flow restriction 26 and/or flow restriction 40 can be modified to change a magnitude of the speed reduction for the turbine. The larger the sum of the venturi and gas port flow area, the faster the turbine will run. The gas port (i.e., flow restriction 26 and/or flow restriction 40) allows independent adjustment of the flow capacity. The venturi is effective over a relatively narrow range of flow ratios (i.e., the secondary flow can only be about 10% to about 30% of the total before the venturi looses effectiveness). In some embodiments, the users can remove the tool from the bore hole and change the size of the flow restrictions in the field.

Although the concepts disclosed herein have been described in connection with the preferred form of practicing them and modifications thereto, those of ordinary skill in the art will understand that many other modifications can be made thereto within the scope of the claims that follow. Accordingly, it is not intended that the scope of these concepts in any way be limited by the above description, but instead be determined entirely by reference to the claims that follow.

The invention in which an exclusive right is claimed is defined by the following:

1. A gas turbine drill tool for minimizing formation damage during drilling and well servicing applications, comprising:

(a) a housing configured to couple to a source of pressurized gas;

(b) a turbine assembly disposed coaxially within the housing, the turbine assembly including a turbine shaft configured to rotate relative to the housing in response to a flow of pressurized gas through the housing, the turbine shaft defining an open ended hollow central volume; and (c) a differential planetary gear transmission disposed coaxially within the housing, the differential planetary gear transmission being configured to receive an input from the turbine shaft and produce an output having a relatively lower speed and larger torque relative to the input provided by the turbine shaft, the differential planetary gear transmission including an annular volume along a central axis of the differential planetary gear transmission, the annular volume being configured to accommodate the turbine shaft, enabling a portion of the drill tool distal of the differential planetary gear transmission to be placed in fluid communication with the central volume in the turbine shaft.

2. The drill tool of claim 1, further comprising a coupling unit disposed distal of the differential planetary gear transmission, the coupling unit being drivingly rotated by the transmission output, the coupling unit sealingly and rotatably engaging the housing, the coupling unit including a central volume that is coupled in fluid communication with the central volume in the hollow turbine shaft, the coupling unit enabling a drill bit to be drivingly attached to the drill tool.

3. The drill tool of claim 2, wherein the central volume in the hollow turbine shaft and the central volume in the coupling unit collectively define a center discharge volume used to place a distal end of the drill tool in fluid communication with a discharge passage in a supply conduit providing the pressurized gas used to rotate the turbine shaft.

4. The drill tool of claim 1, wherein the differential planetary gear transmission comprises:

(a) an upper sun gear having a first diameter, the upper sun gear being rotatingly coupled to the hollow turbine shaft;

(b) a lower sun gear having a second diameter, the lower sun gear being rotatingly coupled to the hollow turbine shaft, the first diameter and the second diameter being different;

(c) an outer ring gear;

(d) an upper spider assembly being fixedly attached to the housing, the upper spider assembly rotatably supporting a plurality of upper planetary gears having a third diameter, the upper planetary gears engaging the upper sun gear and the outer ring gear, rotation of the upper planetary gears causing the outer ring gear to rotate; and (e) a lower spider assembly rotatably supporting a plurality of lower planetary gears having a fourth diameter, the lower planetary gears engaging the lower sun gear and the outer ring gear, the third diameter and the fourth diameter being different, the lower spider assembly being configured to rotate and provide the transmission output at the relatively lower speed and larger torque relative to the input provided by the turbine shaft.

5. The drill tool of claim 4, wherein the diameters of the upper sun gear, the lower sun gear, the upper planetary gears, the lower planetary gears, and the outer ring gear have been selected to enable a speed reduction ratio and torque ratio of about 32:1 to be achieved.

6. The drill tool of claim 4, wherein the differential planetary gear transmission further comprises a vent port enabling pressure compensation of the transmission.

7. The drill tool of claim 1, further comprising a flow restriction element configured to increase a density of the gas in the turbine assembly, to reduce a rotational speed of the turbine shaft, providing an additional speed reduction capability.

8. The drill tool of claim 7, wherein the flow restriction element comprises at least one element selected from a group consisting of:

(a) a port in the housing disposed below the turbine assembly, the port being coupled in fluid communication with a bore hole in which the drill tool is disposed;

(b) a port in a drill bit drivingly rotated by the output of the differential planetary gear transmission; and (c) an annular gap distal of the differential planetary gear transmission, the annular gap defining a primary jet for a venturi capable of generating a pressure differential between a distal end of the drill tool and a proximal end of the drill tool, the venturi producing a vacuum assist to reduce bottom hole pressure.

9. The drill tool of claim 8, wherein the annular gap is disposed between the turbine shaft and a coupling unit drivingly coupled to the transmission output.

10. The drill tool of claim 7, wherein the flow restriction element comprises:

(a) an annular gap distal of the differential planetary gear transmission, the annular gap defining a primary jet for a venturi capable of generating a pressure differential between a distal end of the drill tool and a proximal end of the drill tool, the venturi producing a vacuum assist to reduce bottom hole pressure; and (b) a port in the housing disposed distal of the differential planetary gear transmission, the port being coupled in fluid communication with a bore hole in which the drill tool is disposed.

11. The drill tool of claim 1, further comprising a venturi element disposed distal of the turbine assembly, the venturi element using exhaust gas from the turbine assembly to generate a vacuum assist to reduce bottom hole pressure.

12. The drill tool of claim 11, wherein the venturi element comprises a removable tubular venturi element disposed in the central volume in the hollow turbine shaft, such that the venturi can be reconfigured or eliminated by replacing or removing the tubular venturi element.

13. The drill tool of claim 11, wherein the venturi element generates a Coanda-effect venturi capable of generating a pressure differential between a distal end of the drill tool and a proximal end of the drill tool.

14. An apparatus including a gas turbodrill motor for drilling and bore servicing applications, comprising:

(a) a housing;

(b) a turbine including a turbine shaft configured to rotate relative to the housing, the turbine shaft comprising an open ended central volume;

(c) a first fluid path configured to direct gas through the turbine, thereby causing the turbine shaft to rotate;

(d) a second fluid path configured to direct exhaust gas that has moved through the turbine to an outlet proximate a proximal end of the gas turbodrill motor, the second fluid path extending along a central axis of the housing, the open ended central volume of the hollow turbine shaft defining a portion of the second fluid path; and (e) a differential planetary gear transmission disposed coaxially within the housing, the differential planetary gear transmission being configured to receive an input from the turbine shaft and produce an output having a relatively lower speed and larger torque relative to the input provided by the turbine shaft, the differential planetary gear transmission including an annular volume along a central axis of the differential planetary gear transmission, the annular volume being configured to accommodate the hollow turbine shaft, enabling the second fluid path to extend distal of the differential planetary gear transmission.

15. The apparatus of claim 14, wherein the differential planetary gear transmission comprises:

(a) an upper sun gear having a first diameter, the upper sun gear being rotatingly coupled to the hollow turbine shaft;

(b) a lower sun gear having a second diameter, the lower sun gear being rotatingly coupled to the hollow turbine shaft, the first diameter and the second diameter being different;

(c) an outer ring gear;

(d) an upper spider assembly being fixedly attached to the housing, the upper spider assembly rotatably supporting a plurality of upper planetary gears having a third diameter, the upper planetary gears engaging the upper sun gear and the outer ring gear, rotation of the upper planetary gears causing the outer ring gear to rotate; and (e) a lower spider assembly rotatably supporting a plurality of lower planetary gears having a fourth diameter, the lower planetary gears engaging the lower sun gear and the outer ring gear, the third diameter and the fourth diameter being different, the lower spider assembly being configured to rotate and provide the transmission output at the relatively lower speed and larger torque relative to the input provided by the turbine shaft.

16. The apparatus of claim 15, wherein the diameters of the upper sun gear, the lower sun gear, the upper planetary gears, the lower planetary gears, and the outer ring gear have been selected to enable a speed reduction ratio and torque ratio of about 32:1 to be achieved.

17. The apparatus of claim 14, further comprising a coupling unit disposed distal of the differential planetary gear transmission, the coupling unit being drivingly rotated by the transmission output, the coupling unit sealingly and rotatably engaging the housing, the coupling unit including a central volume such that the second fluid path extends into the coupling unit, the coupling unit enabling a drill bit to be drivingly attached to a distal end of the coupling.

18. The apparatus of claim 14, further comprising a flow restriction element configured to increase a density of the gas in the turbine, to reduce a rotational speed of the turbine output shaft, providing an additional speed reduction capability.

19. The apparatus of claim 18, wherein the flow restriction element comprises at least one element selected from a group consisting of:

(a) a port in the housing disposed below the turbine assembly, the port being coupled in fluid communication with a bore hole in which the apparatus is disposed;

(b) a port in a drill bit drivingly rotated by the differential planetary gear transmission, the port being coupled in fluid communication with a bore hole in which the apparatus is disposed; and (c) an annular gap distal of the differential planetary gear transmission, the annular gap defining a primary jet for a venturi capable of generating a pressure differential between a distal end of the drill tool and a proximal end of the drill tool, the venturi producing a vacuum assist to reduce bottom hole pressure.

20. The apparatus of claim 14, further comprising a venturi element disposed distal of the turbine assembly, the venturi element coupling the inlet volume in fluid communication with the discharge volume, the venturi element producing a vacuum assist to reduce bottom hole pressure.

21. The apparatus of claim 20, wherein the venturi element comprises a removable venturi element disposed in the second fluid path, such that the venturi can be reconfigured or eliminated by replacing or removing the venturi element.

22. A method for controlling a speed of a gas turbine motor for use in drilling and bore hole servicing, the method comprising the steps of:

(a) introducing a pressurized gas into the turbine motor to cause a hollow turbine shaft to rotate at a first speed;

(b) coupling an input of a differential planetary gear transmission to the turbine shaft, the transmission producing an output having a relatively lower speed and larger torque relative to the input provided by the turbine shaft;

(c) diverting exhaust gas discharged from the turbine motor to a location distal of the differential planetary gear transmission; and (d) directing exhaust gas discharged from the turbine motor through a center discharge volume extending through the hollow turbine shaft and the differential planetary gear transmission.

23. The method of claim 22, further comprising the step of directing exhaust gas discharged from the turbine motor through a flow restriction element, thereby increasing a density of the pressurized gas in the turbine motor, to reduce the first speed at which the turbine shaft rotates.

24. The method of claim 23, wherein the step directing exhaust gas discharged from the turbine motor through the flow restriction element comprises at least one step selected from a group of steps consisting of:

(a) the step of directing the exhaust gas through an annular gap defining a primary jet of a venturi that generates a vacuum assist;

(b) the step of directing the exhaust gas through a port into a bore hole in which the apparatus is disposed; and (c) the step of directing the exhaust gas through a port in a drill bit drivingly rotated by the transmission into a bore hole in which the apparatus is disposed.

25. The method of claim 23, further comprising the step changing the flow restriction element, to change a magnitude by which the speed of the turbine shaft is reduced.

26. The method of claim 22, further comprising the step of directing exhaust gas discharged from the turbine motor through a venturi that is in fluid communication with the center discharge volume, thereby producing a vacuum assist to reduce bottom hole pressure.

27. The method of claim 26, further comprising the step of changing the venturi, to change a magnitude of the vacuum assist being provided.

28. The method of claim 27, wherein the step of changing the venturi comprises the step of replacing a venturi element disposed in the center discharge volume.

29. A gas turbine drill tool for minimizing formation damage during drilling and well servicing applications, comprising:

(a) a housing configured to couple to a source of pressurized gas;

(b) a turbine assembly disposed coaxially within the housing, the turbine assembly including a turbine shaft configured to rotate relative to the housing in response to a flow of pressurized gas through the housing; and (c) a differential planetary gear transmission disposed coaxially within the housing, the differential planetary gear transmission being configured to receive an input from the turbine shaft and produce an output having a relatively lower speed and larger torque relative to the input provided by the turbine shaft, the differential planetary gear transmission comprising:

(i) an upper sun gear having a first diameter, the upper sun gear being rotatingly coupled to the turbine shaft;

(ii) a lower sun gear having a second diameter, the lower sun gear being rotatingly coupled to the turbine shaft, the first diameter and the second diameter being different;

(iii) an outer ring gear;

(iv) an upper spider assembly being fixedly attached to the housing, the upper spider assembly rotatably supporting a plurality of upper planetary gears having a third diameter, the upper planetary gears engaging the upper sun gear and the outer ring gear, rotation of the upper planetary gears causing the outer ring gear to rotate; and (v) a lower spider assembly rotatably supporting a plurality of lower planetary gears having a fourth diameter, the lower planetary gears engaging the lower sun gear and the outer ring gear, the third diameter and the fourth diameter being different, the lower spider assembly being configured to rotate and provide the transmission output at the relatively lower speed and larger torque relative to the input provided by the turbine shaft.

* * * * *